US005372119A

United States Patent [19]

Kidney

[11] Patent Number: 5,372,119

[45] Date of Patent: Dec. 13, 1994

[54] QUICK SET REST

[76] Inventor: Charles C. Kidney, 201 Old Batson Rd., Taylors, S.C. 29687

[21] Appl. No.: 13,928

[22] Filed: Feb. 5, 1993

[51] Int. Cl.[5] ..... F41B 5/00

[52] U.S. Cl. ..... 124/44.5; 124/41.1

[58] Field of Search ..... 124/44.5, 41.1, 88

[56] References Cited

U.S. PATENT DOCUMENTS

| | | | |
|---|---|---|---|
| 3,372,686 | 3/1968 | Losh | 124/24.1 |
| 3,537,439 | 11/1970 | Joslin | 124/24.1 |
| 3,935,854 | 2/1976 | Troncosco, Jr. | 124/24.1 |
| 4,287,868 | 9/1981 | Schiff | 124/44.5 |
| 4,344,409 | 8/1982 | Barner | 124/24.1 |
| 4,899,716 | 2/1990 | Martin et al. | 124/44.5 |
| 5,062,407 | 11/1991 | Newbold | 124/44.5 |
| 5,070,855 | 12/1991 | Troncoso | 124/44.5 |
| 5,103,797 | 4/1992 | Newbold | 124/44.5 |
| 5,117,803 | 6/1992 | Johnson | 124/44.5 |
| 5,144,937 | 9/1992 | Colvin | 124/44.5 |

OTHER PUBLICATIONS

Bowhunters Discount Warehouse, Inc., Summer Edition 1992 1045 Zeigler Road, P.O. Box 158 Wellsville, Pa. 17365 pp. 24 and 25.

*Primary Examiner*—Randolph A. Reese
*Assistant Examiner*—Anthony Knight
*Attorney, Agent, or Firm*—Henry S. Jaudon; Cort Flint

[57] ABSTRACT

The invention is directed to a method of set up and sighting-in an arrow rest used with an archery bow. The arrow rest includes a pivotal arrow launcher having vertically extending arrow support fingers. The method includes locating the arrow support fingers in a proper vertical position. Locking the launcher in this position against pivotal movement. Providing a position limit member for limiting the vertical movement of the arrow support fingers to the proper vertical position. Also providing a tensioning member for urging the arrow support fingers into the proper vertical position. Securing the limit member and tensioning member to a position to retain the arrow support fingers in the proper vertical position which partially corrects the shot Arrows Paradox. Mounting the pivotal arrow launcher to a member capable of horizontal adjustment and horizontally adjusting the horizontal adjusting member to properly locate the arrow support fingers horizontally of the bow. The method provides for the arrow rest to be sighted-in to properly position the arrow launcher vertically without disturbing the horizontal setting and to position the arrow launcher horizontally without disturbing the vertical setting. The method further includes adjusting the tension of the tensioning means to control the degree of downward movement of the arrow launcher during arrow launch. The adjustment of tension is also made without disturbing the vertical and horizontal settings of the arrow launcher.

24 Claims, 4 Drawing Sheets

QUICK SET REST

BACKGROUND OF THE INVENTION

The present invention is directed to an arrow rest adapted for use with an archer's bow, preferably an archer's compound bow. The arrow rest is designed for easy, quick and yet extremely accurate set up and sighting-in.

The prior art consist of numerous designs for arrow rests such as those shown on pages 24 and 25 of Bowhunters' Discount Warehouse, Inc. catalog, Summer edition, 1992. Each of these arrow rests is designed to be mounted with a bow. Each includes an arrow launcher. Each possesses adjustment arrangements where the arrow launcher may be adjusted for its vertical position and its horizontal position relative to the bow. Each contains the singular drawback which the arrow rest of the present invention is designed to eliminate, i.e. the vertical or horizontal positions cannot be locked in during sighting-in adjustment while the other position is being adjusted.

Accordingly, it is an object of this invention to provide an arrow rest which is easily and accurately adjusted during sighting-in.

Another object of the invention is to provide an arrow rest in which the vertical position of the arrow launcher may be locked in while the horizontal adjustment is being made.

Another object of the invention is to provide an arrow rest in which the horizontal position of the arrow launcher may be locked in during adjustment of its vertical position.

Another object of the invention is to provide mechanisms to allow tension adjustments on the arrow launcher while its vertical and horizontal positions are locked in position.

SUMMARY OF THE INVENTION

The invention is directed to a method of set up and sighting-in an arrow rest used with an archery bow. The arrow rest includes a pivotal arrow launcher having partially vertically extending arrow support fingers. The method includes locating the arrow support fingers in a proper vertical position. Locking the launcher in this position against pivotal movement. Providing a position limit member for limiting the vertical movement of the arrow support fingers to the proper vertical position. Also providing a tensioning member for urging the arrow support fingers into the proper vertical position. Securing the limit member and tensioning member to a position to retain the arrow support fingers in the proper vertical position under proper tension. Mounting the pivotal arrow launcher to a member capable of horizontal adjustment and horizontally adjusting the horizontal adjusting member to properly locate the arrow support fingers horizontally of the bow. The method provides for the arrow rest to be sighted-in to properly position the arrow launcher vertically without disturbing the horizontal setting and to position the arrow launcher horizontally without disturbing the vertical setting. The method further includes adjusting the tension or resistance of the tensioning means to control the degree of downward movement of the arrow launcher during arrow launch. The adjustment of tension is also made without disturbing the vertical and horizontal settings of the arrow launcher.

The arrow rest of the invention is capable of quick and accurate sighting-in adjustment. The rest includes an arrow launcher having arrow support fingers pivotally mounted with a slide block and adjustably supported in a proper vertical position. A collar is circumferentially adjustably secured with the arrow launcher and functions to maintain the arrow support fingers in the adjusted vertical position. A resilient member urges the support fingers to the adjusted vertical position and also determines the degree of pivotal movement of the arrow launcher moves away from the adjusted vertical position during arrow launching.

The arrow rest includes a mounting member which is secured with the archery bow. The mounting member includes a dovetail slot at one end which mounts a slide block for horizontal movement. Locking means are carried by the mounting member for securing the slide block against movement. The mounting member also includes a lock screw which is operative to engage with and secure the slide block in an adjusted horizontal position relative to the mounting member.

The slide block includes a horizontal bore in which are fitted synthetic bearing members. The bearing members act to pivotally mount a support shaft of the arrow launcher. The arrow launcher may be a unitary member with the arrow support fingers formed integral with the support shaft. The arrow launcher may alternately be a multi-member unit consisting of a support shaft pivotally mounted with the slide block. The arrow support fingers may consist of a U-shaped rod having a pair of support pods formed on its free ends. An extension may interconnect with the U-shape rod intermediate its length. The arrow support fingers are interconnected with the support shaft by uniting the extension with a mounting and securing structure formed in one end of the support shaft.

A first and second collar, are mounted with the support shaft of the arrow launcher. Each collar mounts a set screw which allows circumferential and longitudinal adjustment of the collars with the pivoting support shaft. One of the collars includes a stop screw arranged opposite the set screw. A stop pin extends from one side of the slide block in position to engage the stop screw and prevent further rotation of the support shaft. A resilient member engages with the lock screw of the collar and engages with an adjustable slide block. The resilient member acts to urge the stop member into contact with said stop pin. The slide block is mounted for longitudinal adjustment relative to the slide block.

The device or at least the arrow support fingers of the arrow launcher may be coated with titanium nitrite or chromium nitrite for increased wearability. In addition to or alternatively, they may be coated with an epoxy resin or urethane resin which allows the arrow launcher to launch an arrow in substantially complete silence.

A securing member is carried by the slide block. The securing member acts to temporarily secure the support shalt of the arrow launcher against rotation. The securing member comprises a set screw having a lock patch arranged in the side thereof and a bronze tip. The lock patch functions to prevent unwanted accidental movement of the set screw.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The instant invention which is shown in the accompanying drawings, is directed to an arrow rest A for use with an archer's bow B. Bow B may be any type, however, arrow rest A is most preferably used with a compound bow similar to that shown in FIG. 4.

When sighting-in bow B, it is essential that arrow rest A be adjusted so that arrow 10 lies along a single plane or is dead level from the point where it connects with bow string 12 and engages with arrow rest A. Also, it is essential that the vertical axis of string 12 at the point of engagement with arrow 10 and the longitudinal axis of the arrow be disposed at a right angle and lie along a single plane.

Figure 4:
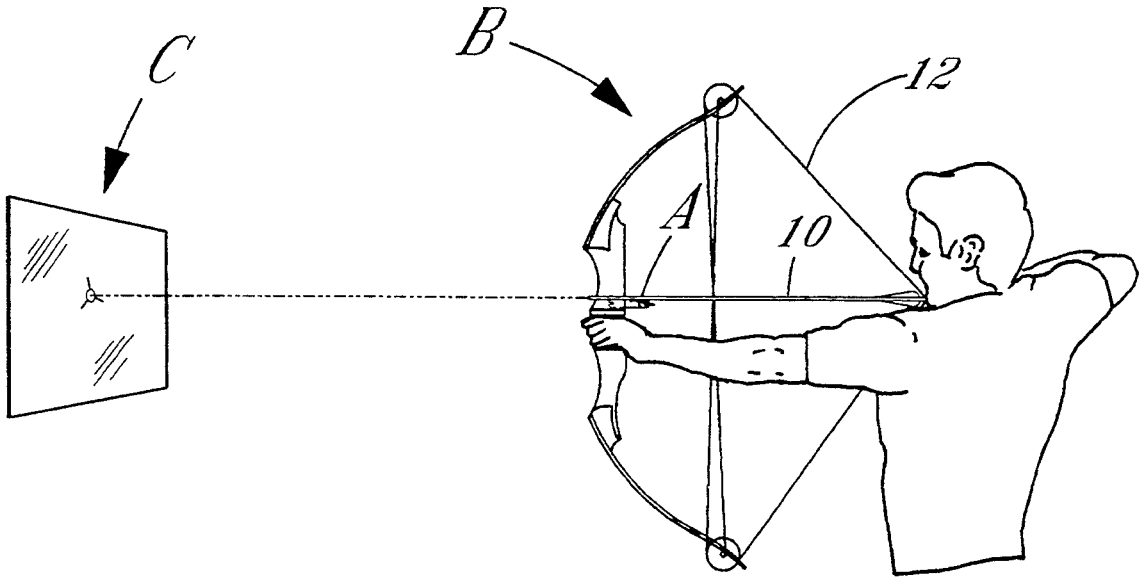
FIG. 4 is a side view of an archer sighting-in on a target.
Figure 5:
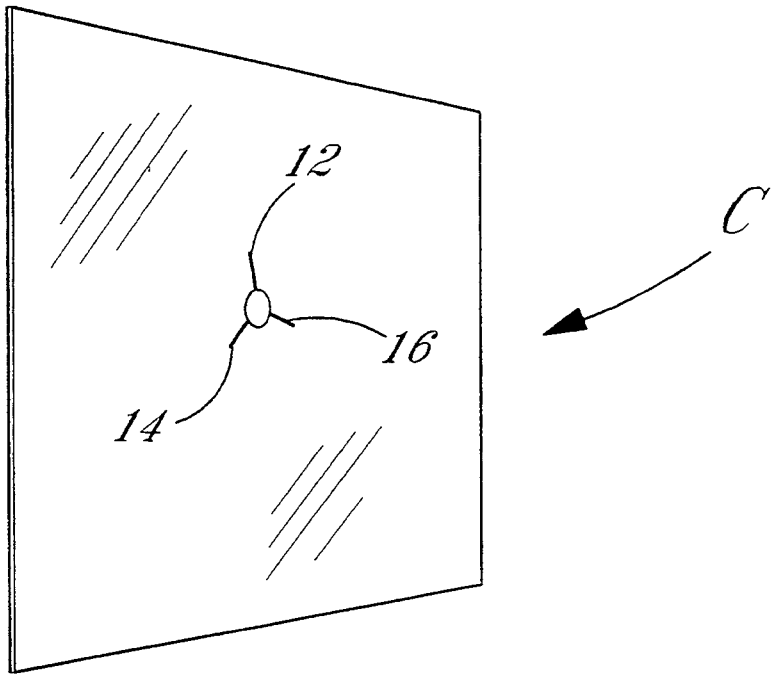
FIG. 5 is a perspective view of a target which has been shot with an arrow launched from a properly sighted-in arrow rest.

Viewing now FIGS. 4 and 5, there is shown an archer preparing to launch an arrow from bow B toward target C. The target consists of a vertically arranged piece of paper. The archer aims at a point on target C which is generally parallel with the plane along which arrow 10 lies. The arrow, when fired, passes through the paper target leaving a hole surrounded by three radially extending slits 12, 14 and 16. Should slits 12, 14 and 16 be perfectly smooth, as shown in FIG. 5, the bow is correctly sighted in. Should slit 12 be slightly torn, this would indicate a vertical adjustment of the arrow rest is necessary. Should slits 14 and 16 be slightly torn than a horizontal or horizontal and vertical adjustment would be necessary. It is extremely important that while making a vertical adjustment, the horizontal setting be maintained and while making a horizontal adjustment the vertical setting be maintained. The arrow rest of the invention is constructed to function in this manner.

Figure 1:
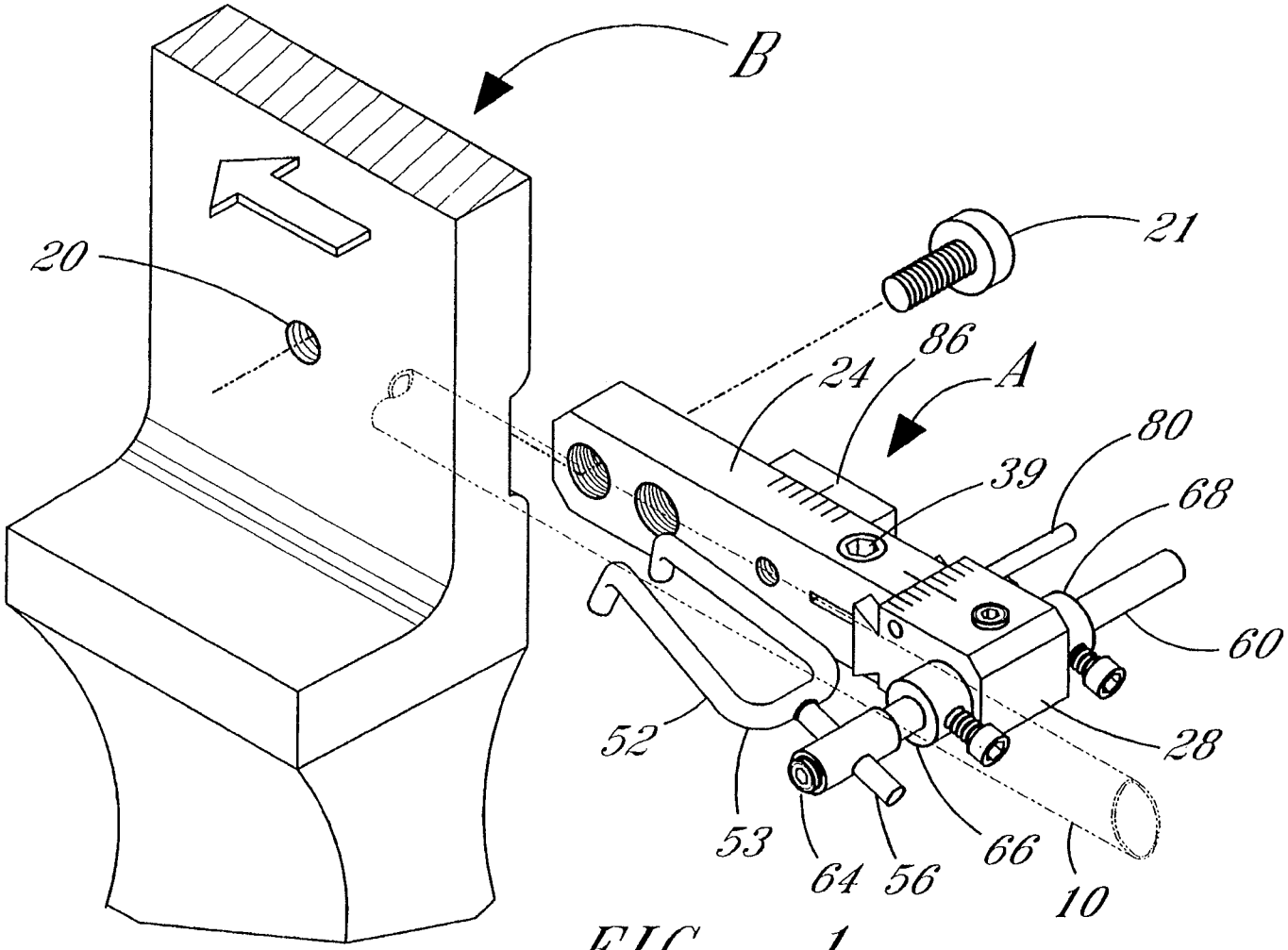
FIG. 1 is a sectional perspective view, from the left side of the arrow rest of the invention connected with an archer's bow.
Figure 2:
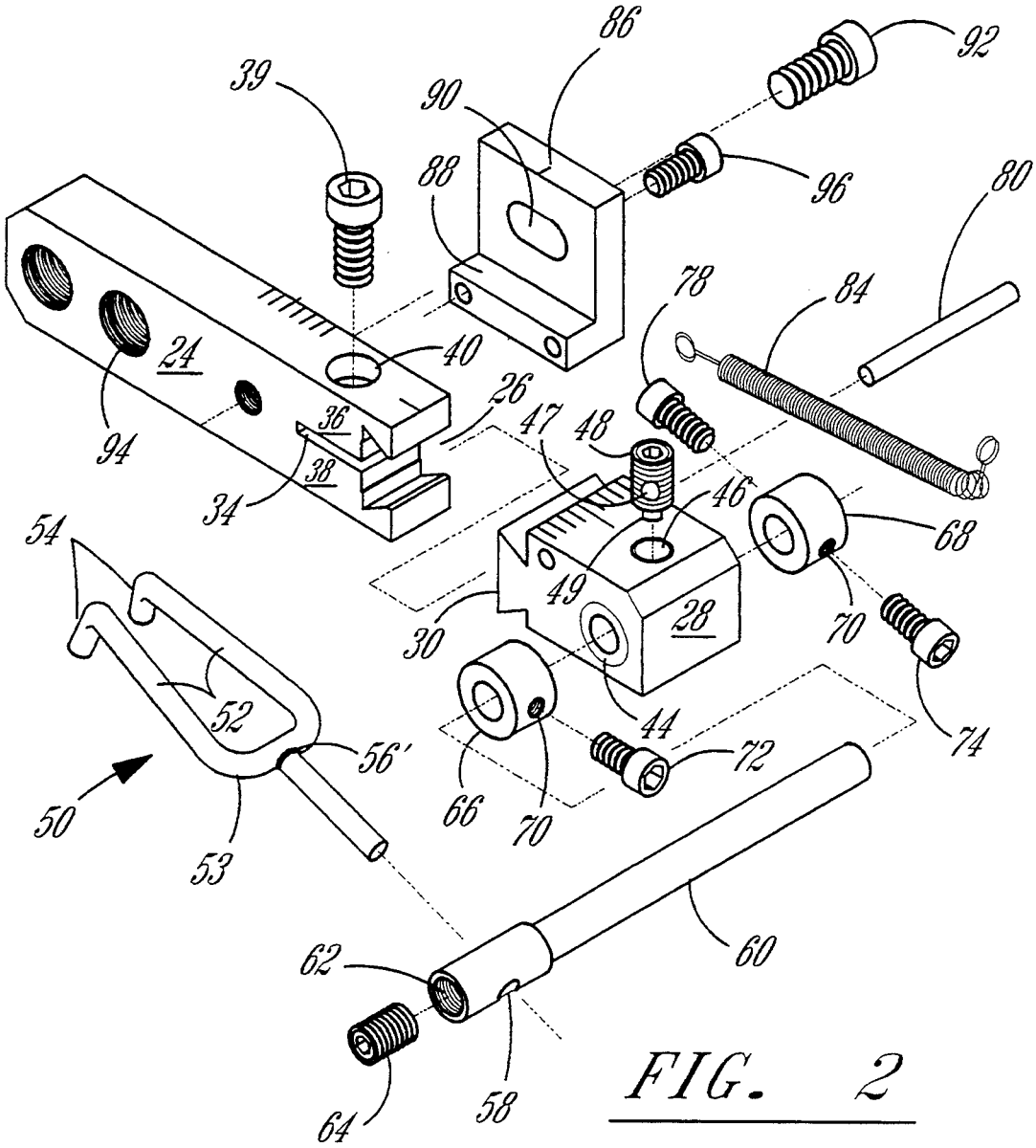
FIG. 2 is an exploded perspective view of the arrow rest of the invention.
Figure 6:
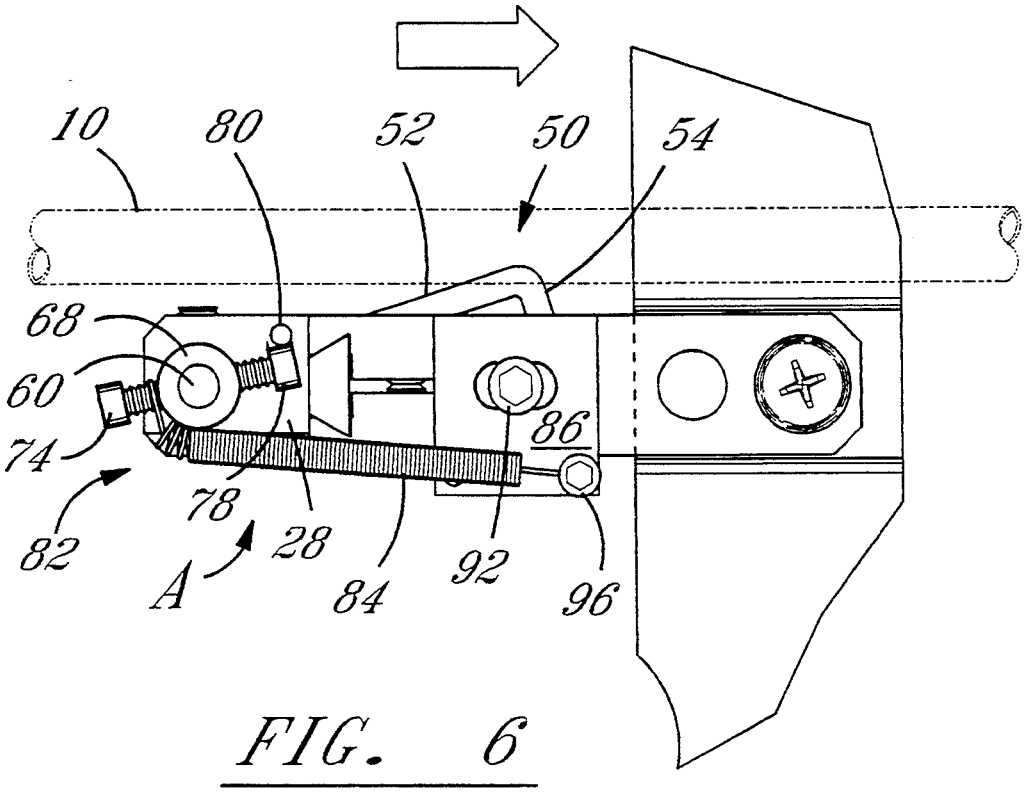
FIG. 6 is a side view of the arrow rest of the invention.

Viewing now FIGS. 1, 2, and 6, arrow rest A can be seen mounted with the riser of bow B by securing bolt 21 which passes through a selected of the pair of apertures in mounting block 24 to threadably engage with opening 20 to secure it with bow B. Mounting block 24 has a dovetail slot 26 formed in one end. Dovetail slot 26 is bisected by a longitudinal slot 34 which forms fingers 36 and 38 in the end of mounting block 24. Slide block 28, which has a dovetail 30 formed on one end, is adapted to be received in dovetail slot 26. The shaft of lock screw 39 passes through opening 40 in finger 36 and threadably engages with a threaded aperture formed in finger 38. Rotation of lock screw 38 acts to draw fingers 36 and 38 together thus causing dovetail slot 26 to lock with dovetail 30 and secure slide block 28 in position. Rotation of lock screw 39 in the opposite direction allows fingers 36 and 38 to separate. This allows slide block 28 to be moved horizontally relative to mounting block 24. Indicia may be provided on an upper surface of slide block 28 and/or mounting block 24 to assist in accurate and precise horizontal adjustment. Locking screw 39 may carry a locking patch, such as locking patch 47 carried by set screw 48 shown in FIG. 2, to prevent accidental movement of the screw.

Slide block 28 has a horizontal bore 42 which passes completely through the block. Synthetic bushings 44 are fitted in opposite ends of bore 42. Also, vertical threaded bore 46 extends through the upper surface of slide block 28 and connects with horizontal bore 42. Set screw 48 is threadably received in bore 46. Set screw 48 is provided with a locking patch 47 which is arranged in the side thereof as best shown in FIGS. 2. The locking patch, which is known, acts with the internal threads of bore 46, to inhibit or deter rotation of set screw 48 which may be caused by vibrations incurred during use. Set screw 48 is also provided with a bronze or composite tip 49 positioned to engage with support shaft 60 when set screw 48 is moved to its locking position. Tip 49, which is formed of a relatively soft material compared to the material forming support shaft 60 prevents scoring of the shaft.

A pivotal arrow launcher 50 consist of a pair of arrow support fingers 52, which are formed from a U-shaped rod 53. The free ends of arrow support fingers 52 are bent at substantially right angles to the axis of the fingers to form arrow support pods 54. A pin 56 is secured with rod 53 at an intermediate point 56' and is arranged to extend along the same plane as fingers 52. A support shaft 60 is provided at one end with an aperture 58 which is intersected by a threaded bore 62. Pin 56 passes through aperture 58 and is secured with support shaft 60 by set screw 64 which is threaded in slot 62. Pin 56 allows vertical adjustment for the arrow launcher, this adjustment is an initial adjustment not used when sighting in.

Support shaft 60 is pivotally received in bore 42 of slide block 28. The support shaft carries a first collar 66 adjacent a first side of the slide block and a second collar 68 on the opposite side of slide block 28. Collars 66, 68 each have a threaded bore which receives lock screws 72 and 74 respectively. The collars along with the lock screws secure support shaft 60 against horizontal movement relative to slide block 28. The collars also allow for an initial horizontal adjustment of the arrow launcher. This initial adjustment is for major setting changes and is not usually used during sighting in.

Collar 68, as best seen in FIG. 2 and 6, is provided with a second threaded bore which receives a stop member 78. A stop pin 80 extends from the side of slide block 28 in position to engage with stop member 78 which engagement acts to limit rotational movement of collar 68 which when secured with shaft 60 limits rotational movement of the shaft.

A tensioning mechanism 82 is arranged on one side of mounting block 24. The tensioning mechanism includes a spring 84 which is connected with slide block 86 by lock screw 96 and with collar 68 by lock screw 74. Slide block 86 is connected with mounting block 24 by lock screw 92 which passes through slot 90 formed in the slide block and engages in threaded bore 94. Slide block 86 is provided with an offset shoulder 88 which is in sliding contact with the undersurface of mounting block 24. Shoulder 88 provides stability for slide block 86 relative to mounting block 24. The tensioning mechanisms 82 acts to urge stop member 78 toward and into engagement with stop pin 80 so that they remain in substantially continuous contact. The spring tension of the tensioning mechanism 82 allows controlled flexing of the arrow being shot. This flexing is commonly known as the Arrows Paradox.

Arrow launcher A operates in the following manner during sighting-in. The archer loosens set screws 74 to allow support shaft 60 of arrow launcher 50 circumferential movement relative to collars 66*a* and 68. By rotating support shaft 60, arrow support fingers 52 are brought to a proper vertical position. Set screw 48 is lightly tightened to hold support shaft 60 in position. Support shaft 60 is now moved horizontally, making an initial adjustment in the horizontal setting of arrow support fingers 52. Set screw 48 is now tightened to lock shaft 60 in position. Lock screw 74 of collar 66 is then tightened securing the collar with shaft 60. Lock screw 74 is tightened to secure collar 68 with support shaft 60 with stop member 78 in engagement with stop pin 80. Support shaft 60 is now locked against horizontal movement relative slide block 28 by collars 66, 68 and against counter clockwise movement by stop pin 80. Arrow launcher 50, which may rotate clockwise against spring 84 is now set with arrow support fingers in the proper vertical position. Lock screw 39 is now loosened to allow fine horizontal adjustment of slide block 28 and with the horizontal adjustment of arrow launcher 50. Upon making a horizontal selection lock screw 39 is rotated to secure the slide block in position. Tensioning mechanism 82 is now adjusted by moving block 86 longitudinally of positioning marks on mounting block 24. Upon selecting a proper position, lock screw 92 secures slide block 86 in position. Set screw 48 is slackened to allow rotation of support shaft 60 and the arrow rest is ready for the archer to fire a first arrow during sighting-in.

Upon firing the arrow, the force generated by the bow in moving the arrow in the direction indicated causes the arrow launcher 50 to pivot clockwise as viewed in FIG. 6, against the force of tensioning mechanism 82. Should the tension be too great or too small, the arrow will be off-line accordingly and will be so indicated by slits 12, 14, or 16 in target C as set forth earlier. To further adjust the tensioning mechanism, set screw 48 is moved to lock support shaft 60 in position and slide block 86 is moved in the appropriate direction to adjust the tension without disturbing the vertical adjustment or the horizontal adjustment of arrow launcher 50. This procedure is also employed when it is desired to change spring 84.

Further adjustment of the horizontal position of arrow launcher 50 may likewise be made without disturbing either of the other adjustments. Likewise, further vertical adjustment of arrow launcher 50 may be made without disturbing the tension adjustment or the horizontal adjustment.

Figure 3:
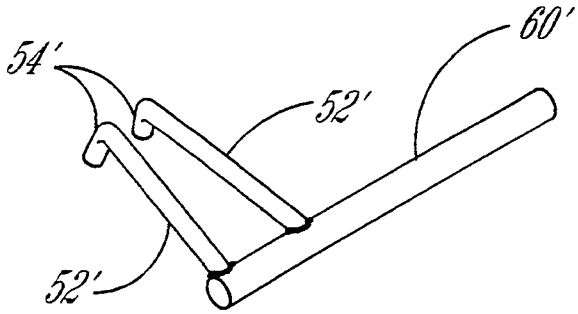
FIG. 3 is a perspective view of an alternative arrow launcher arrangement.

FIG. 3 is directed to an alternative arrangement of an arrow launcher 50'. Here, arrow support fingers 52' are permanently fixed with support shaft 60'. The arrow support fingers are shaped to include pods 54' and are arranged relative to each other as in the earlier described arrow launcher 50. Arrow launcher 50' is interchangeable with the arrow launcher 50.

Figure 7:
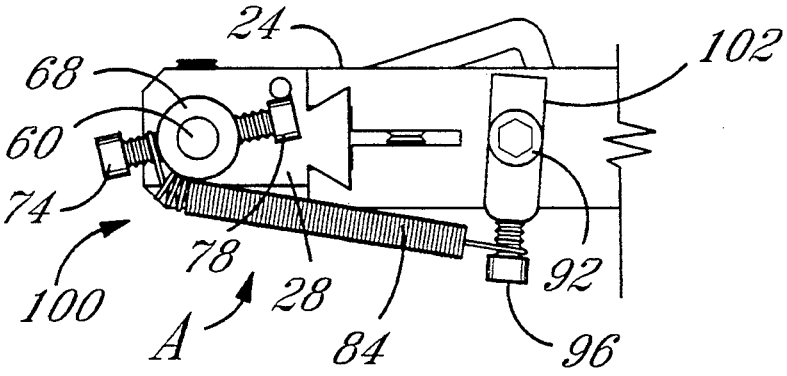
FIG. 7 is a side view of an alternative arrangement of the tensioning control of the arrow rest.
Figure 8:
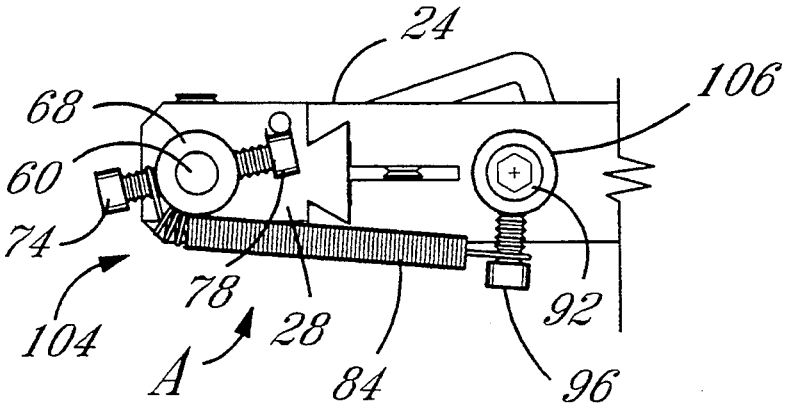
FIG. 8 is a side view of a second alternative arrangement of the tensioning control of the arrow rest.

An alternative tensioning mechanism 100 is shown in FIG. 7. In tensioning mechanism 100, the tension adjusting member comprises lever 102 which is pivoted about lock screw 92 and is attached to mounting block 24 at a fixed location. Spring 84 continues to be attached at one end to collar 68 by lock screw 74. The opposite end of spring 84 is attached to the lower end of lever 102 by lock screw 96. To adjust the tension urging arrow launcher 50 to its substantially vertical position, lever 102 is rotated about lock screw 92. When the adjustment has been made, lever 92 is locked in position against mounting block 24 by the lock screw. A second alternative tensioning mechanism 104 can be seen in FIG. 8. In this arrangement, lever 102 is replaced with a collar 106. Spring 84 is secured with collar 106 by lock screen 96. The arrangement operates in the manner described for tensioning mechanism 100 with collar 106 being substituted for lever 102.

Tensioning mechanisms 100 and 104 function with other components of arrow launcher A in the same manner as does tensioning mechanism 82 described above.

While a preferred embodiment of the invention has been described using specific terms, such description is for illustrative purposes only, and it is to be understood that changes and variations may be made without departing from the spirit or scope of the following claims.

What is claimed is:

1. An arrow rest for use with an archery bow capable of quick and accurate set up and sighting-in adjustment, comprising;

a mounting block carrying a slide block;

an arrow launcher including arrow support fingers carried by a shaft pivotally mounted with said slide block, said arrow launcher being normally retained in an arrow support position;

a stop pin carried by said slide block;

adjustable resilient means acting to rotatably urge said shaft and said arrow launcher in a first direction to said arrow support position;

a circumferentially adjustable collar and stop member carried by said shaft and means normally locking said collar and stop member for rotation with said shaft, said stop member being urged by said resilient means to be normally in engagement with said stop pin in said arrow support position;

a set screw carried by said slide block, said set screw being operative to selectively engage with and immobilize said shaft and said arrow launcher, whereby;

said arrow rest may be sighted in by disconnecting said means locking said collar with said shaft;

bringing said arrow launcher to a proper arrow support position and moving said set screw to immobilize said shaft;

adjusting said circumferential position of said collar and stop member with said shaft and locking said collar for rotation with said shaft;

adjusting the horizontal position of said slide block relative to said mounting block; and disconnecting said set screw from said shaft.

2. The device of claim 1 wherein said mounting block is adapted to be secured with said archery bow, and includes a dovetail slot formed in one end, said dovetail slot mounts said slide block for horizontal movement.

3. The device of claim 2 wherein said mounting block includes locking means operative to secure said slide block in an adjusted horizontal position.

4. The device of claim 3 wherein said locking means carried by said mounting block comprise a locking screw and opposed faces of said dovetailed slot, said locking screw being adapted to draw said opposite faces of said dovetailed slot toward each other.

5. The device of claim 4 wherein said locking screw of said locking means includes a lock patch which acts to prevent accidental movement of said locking screw.

6. The device of claim 2 wherein said slide block includes a dovetail which co-operates with said dovetail slot of said mounting block.

7. The device of claim 1 wherein said arrow launcher comprises a unitary member with said arrow support fingers formed integral with said shaft.

8. The device according to claim 1 wherein said arrow support fingers of said arrow launcher include a pair of support pods formed on free ends of a U-shaped rod and an extension formed integral with said U-shape rod intermediate its length, said extension and said U-shaped rod extending substantially along a single plane and;

said shaft includes mounting and securing means formed in one end thereof which receive and secure said extension of said arrow support fingers with said shaft.

9. The device of claim 1 wherein said means locking said collar comprises a lock screw.

10. The device of claim 9 wherein said resilient means comprises a spring which engages with said lock screw of said collar and an adjustable slide block.

11. The device of claim 10 wherein means mount said slide block with said mounting block for longitudinal adjustment.

12. The device of claim 9 wherein said resilient means comprises a spring attached at a first end with said collar and at a second end with an adjustable lever.

13. The device of claim 12 wherein said lever is adjustably secured in position on a side of said mounting block with a lock screw.

14. The device of claim 9 wherein said resilient means includes a spring attached at one end to said collar and at a second end to a second collar and means adjustably securing said second collar with said mounting block.

15. The device of claim 9 wherein said lock screw is provided with a lock patch to prevent accidental movement of said set screws.

16. The device of claim 1 wherein said set screw includes a lock patch arranged in the side thereof and a bronze or composite tip formed on the end thereof, said lock patch functioning to prevent accidental rotation of said set screw, said tip functioning to prevent scoring of said pivotal shaft.

17. The device of claim 1 wherein at least said arrow support fingers of said arrow launcher are coated with one of titanium nitrite and chromium nitrite for increased wearability.

18. The device of claim 1 wherein at least said arrow support fingers of said arrow launcher are coated with at least one of an epoxy resin and urethane resin which allows the arrow launcher to launch an arrow substantially noiselessly.

19. The device of claim 1 wherein said slide block includes a horizontal bore having synthetic bearing members carried therein, said bearing members acting to pivotally mount said shaft of said arrow launcher.

20. A method of sighting-in an arrow rest used with an archery bow having a vertical setting and a horizontal setting, said method including;

providing an arrow launcher having a pivotal support shaft to which radially extending arrow support fingers are integrally formed;

rotating said support shaft to locate said arrow support fingers in a proper vertical position and locking said support shaft against further pivotal movement;

providing position limit means for limiting the pivotal movement of said support shaft and with said support shaft locked against pivotal movement circumferentially adjusting said limit means about said support shaft into position to maintain said support fingers in said proper vertical position;

providing tensioning means and connecting said tensioning means with said limit means to cause said tensioning means to rotatably urge said support shaft toward said adjusted position with said support fingers in said proper vertical position and unlocking said support shaft to allow pivotal movement thereof;

providing horizontal adjusting means for adjusting said support fingers horizontally of said arrow rest and horizontally adjusting said horizontal adjusting means to properly locate said arrow support fingers horizontally of said arrow rest; whereby said arrow rest may be sighted-in to properly position said arrow support fingers vertically without disturbing the horizontal setting and said arrow rest may be sighted-in to properly position said arrow support fingers horizontally without disturbing said vertical setting of said arrow rest.

21. The method of claim 20 further including adjusting the tension of said tensioning means to control the degree of downward movement of said arrow support fingers during launch, said tensioning adjustment being made without disturbing said vertical and horizontal settings.

22. An arrow rest for use with an archer's bow adapted for accurate sighting-in, said arrow rest comprising;

a pivotal arrow launcher carried by a mounting block, resilient means connected with said pivotal arrow launcher adapted to urge said pivotal arrow launcher in a first direction;

securing means carried by said mounting block, said securing means being operative to engage with and secure said pivotal arrow launcher against movement when said pivotal arrow launcher is adjusted to a desired vertical position;

collars carried by said pivotal arrow launcher, said collars being circumferentially and axially adjustable relative to said pivotal arrow launcher;

means carrying said mounting block for horizontal adjustment, said mounting block having a stop arranged on one side thereof; whereby a horizontal adjustment of said pivotal arrow launcher may be made without effecting said vertical position of said pivotal arrow launcher, said collars may be circumferentially adjusted relative to said pivotal arrow launcher to cooperate with said stop and said resilient means without moving said pivotal arrow launcher from said desired vertical position and said securing means may be out of engagement with said pivotal arrow launcher to allow pivotal movement of said pivotal arrow launcher to and from said desired vertical position after the sighting-in adjustments have been made.

23. The device of claim 22 wherein said resilient means includes an adjustable lever and a spring attached at opposite ends with one of said collars and with said lever.

24. The device of claim 22 wherein said resilient means includes an additional collar and a spring attached at one end to one of said collars and at a second end to said additional collar.

* * * * *